US006459873B1

(12) United States Patent
Song et al.

(10) Patent No.: US 6,459,873 B1
(45) Date of Patent: Oct. 1, 2002

(54) DC PIN SCOROTRON CHARGING APPARATUS, AND PRINTING MACHINE ARRANGED WITH THE SAME

(75) Inventors: Jing Qing Song, Webster; John F. Obrien, Fairport; David Sekovski, Rochester; Robert K. Fox, Fairport; John D. McCaffrey, Rochester; Jeffrey W. Drawe, Bloomfield, all of NY (US)

(73) Assignee: Xerox Corporation, Stamford, CT (US)

( * ) Notice: Subject to any disclaimer, the term of this patent is extended or adjusted under 35 U.S.C. 154(b) by 16 days.

(21) Appl. No.: 09/713,699

(22) Filed: Nov. 15, 2000

(51) Int. Cl.[7] ..... G03G 15/02
(52) U.S. Cl. ..... 399/171
(58) Field of Search ..... 399/50, 80, 89, 399/100, 115, 168, 170, 171; 250/324, 325, 326; 361/225, 229, 230, 234; 430/902

(56) References Cited

U.S. PATENT DOCUMENTS 4,725,732 A 2/1988 Lang et al. ..... 250/326
5,257,073 A * 10/1993 Gross et al. ..... 399/171
5,537,198 A 7/1996 Jackson ..... 399/168
6,002,899 A * 12/1999 Stover et al. ..... 399/148
6,097,915 A * 8/2000 Fleck et al. ..... 399/171

* cited by examiner

*Primary Examiner*—Sophia S. Chen
*Assistant Examiner*—Hoan Tran
(74) *Attorney, Agent, or Firm*—Wayne J. Egan

(57) ABSTRACT

In DC pin scorotron charging apparatus for charging a photoreceptor to a final voltage, a first DC pin scorotron charging device initially charges the photoreceptor to an intermediate overshoot voltage and a second DC pin scorotron charging device thereafter uniformly charges the photoreceptor to the final voltage. The first DC pin scorotron charging device provides a generally high percent open control grid area, a generally high emitter slope, and a generally high emitter pin current. The second DC pin scorotron charging device provides a generally low percent open control grid area, a generally low emitter slope, and a generally low emitter pin current.

28 Claims, 3 Drawing Sheets

DC PIN SCOROTRON CHARGING APPARATUS, AND PRINTING MACHINE ARRANGED WITH THE SAME

INCORPORATION BY REFERENCE OF ANOTHER U.S. PATENT

The applicant hereby incorporates by reference the disclosure of U.S. Pat. No. 4,725,732 to Joseph H. Lang et al., entitled "Pin corotron and scorotron assembly," issued Feb. 16, 1988, verbatim and with the same effect as though such disclosure were fully and completely set forth herein.

The applicant hereby incorporates by reference the disclosure of U.S. Pat. No. 5,537,198 to Mark S. Jackson, "Double split recharge method and apparatus for color image formation," issued Dec. 12, 1994, verbatim and with the same effect as though such disclosure were fully and completely set forth herein.

FIELD OF THE INVENTION

This application relates generally to xerography and more particularly to DC pin scorotron charging apparatus for charging a photoreceptor in a xerographic printing machine.

BACKGROUND OF THE INVENTION

It is known to use charging devices in xerographic printing. Such charging devices are typically of the following types: corotron, dicorotron, pin corotron, scorotron, discorotron, and pin scorotron. See, generally, R. M. Schaffert, "Electrophotography," The Focal Press, New York, 1965.

As known, such charging devices include a chamber arranged with one or more charge-generating emitters such as, for example, a wire, a dielectric wire, or a pin array.

As is known, some charging devices include a control grid to regulate and control the charge provided to the photosensitive member, resulting in the photosensitive member receiving a uniform charge. Such charging devices with control grids are typically of the following types: scorotron, discorotron, and pin scorotron. Some benefits and problems associated with such control grids are discussed in Lewis E. Walkup, U.S. Pat. No. 2,777,957, especially FIGS. 4–7 and the text corresponding thereto. See also Geoffrey M. T. Foley, U.S. Pat. No. 4,638,397, especially columns 1–2.

As is known, one key characteristic of a charging device is its charge-generating emitter's dI/dV ratio, commonly known as the emitter "slope", which is generally expressed in units of Amperes per volt-meter.

One example of a low-cost charging device is a traditional direct-coupled ("DC") pin scorotron. One example of such a DC pin scorotron is disclosed in the aforementioned U.S. Pat. No. 4,725,732 to Joseph H. Lang et al.

It is known that uniform photoreceptor charging is required to achieve high-quality xerographic results. Various ways to achieve desired levels of uniform charging are known.

For example, the aforementioned U.S. Pat. No. 5,537,198 to Mark. S. Jackson in FIG. 1 discloses a first recharging station D comprising multiple consecutively-positioned corona recharging devices 36, 37 and 38 arranged to uniformly recharge a photoreceptor belt 10. As well, this same Mark S. Jackson in FIG. 1 patent discloses a second recharging station F comprising multiple consecutively-positioned corona recharging devices 51, 52 and 53 arranged to uniformly recharge the photoreceptor belt 10. Finally, this same Mark S. Jackson in FIG. 1 patent discloses a third recharging station H comprising multiple consecutively-positioned corona recharging devices 61, 62 and 63 arranged to uniformly recharge the photoreceptor belt 10.

DC pin scorotron-type charging devices offer several key advantages over other types of charging devices. One key advantage is their relative low cost. Other advantages of DC pin scorotrons include lower ozone emissions and lower noise.

As a result of the above advantages, it is presently desired to achieve uniform photoreceptor charging by means of using multiple DC pin scorotron-type charging devices.

However, it is commonly known that the charging uniformity of a DC pin scorotron is not as good as some other types of charging devices.

As a result, the problem is how to meet the charging uniformity required for the next generation of high-quality copy and printing machines by means of multiple DC pin scorotron charging devices.

While the aforementioned Mark S. Jackson patent discloses a method of achieving uniform photoreceptor charging by means of multiple corona-type charging devices, it is noted that this patent does NOT disclose any way of achieving uniform photoreceptor charging by means of multiple DC pin scorotron charging devices.

As a result, there is a need for charging apparatus for achieving uniform photoreceptor charging by means of multiple DC pin scorotron charging devices.

DESCRIPTION OF THE PREFERRED EMBODIMENTS

Figure 1A:
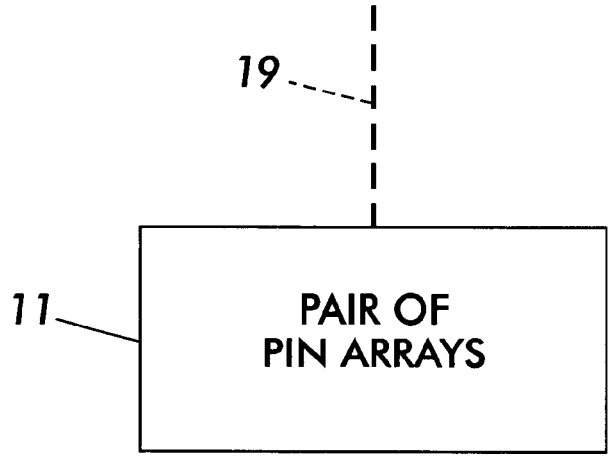
FIG. 1A is a block diagram depicting a first embodiment of DC pin scorotron charging apparatus 100, in accordance with the present invention.

Briefly, in accordance with the present invention, DC pin scorotron charging apparatus for charging a photoreceptor to a final voltage comprises a first DC pin scorotron charging device for initially charging the photoreceptor to an intermediate overshoot voltage and a second DC pin scorotron charging device for thereafter uniformly charging the photoreceptor to the final voltage. The first DC pin scorotron charging device comprises a generally high percent open control grid area, a generally high emitter slope, and a generally high emitter pin current. The second DC pin scorotron charging device comprises a generally low percent open control grid area, a generally low emitter slope, and a generally low emitter pin current.

Referring now to FIG. 1, there is shown DC pin scorotron charging apparatus 100 for charging a photoreceptor 50 to a final voltage 52. The DC pin scorotron charging apparatus 100 comprises a first DC pin scorotron charging device 10 for initially charging 19 the photoreceptor 50 to an intermediate overshoot voltage 51. The DC pin scorotron charging apparatus 100 also comprises a second DC pin scorotron charging device 20 for thereafter uniformly charging 29 the photoreceptor 50 to the final voltage 52. The photoreceptor 50 comprises a photosensitive belt that moves at a speed 55.

In accordance with the present invention, the charging performance of the DC pin scorotron charging apparatus 100 accommodates high process speeds 55 such as, for example, speeds at or above 18 inches per second.

As shown the first DC pin scorotron charging device 10 comprises a first control grid 12 comprising a first screen with a first grid percent open area that is generally high. As well, the second DC pin scorotron charging device 20 comprises a second control grid 22 comprising a second screen with a second grid percent open area that is generally low.

In one embodiment, the first grid percent open area is 70–85 percent, and the second grid percent open area is 50–70 percent.

Still referring to FIG. 1, the first control grid 12 is biased at a first grid voltage 13 and the second control grid 22 is biased at a second grid voltage 23.

In one embodiment, the intermediate overshoot voltage 51 exceeds the first grid voltage 13, and the final voltage 52 exceeds the intermediate overshoot voltage 51.

In another embodiment, the final voltage 52 is between 300 and 1000 volts.

In still another embodiment, the second grid voltage 23 is about 30–150 volts above the first grid voltage 13.

The first DC pin scorotron charging device 10 comprises a first charge-generating emitter 11 with a first emitter dI/dV ("slope") that is generally high. As well, the second DC pin scorotron charging device 20 comprises a second charge-generating emitter 21 with a second emitter slope that is generally low.

In one embodiment, the first emitter slope exceeds 2.0 micro-Ampere per volt-meter, and the second emitter slope is less than 2.0 micro-Ampere per volt-meter.

Still referring to FIG. 1, it is seen that the photoreceptor 50 comprises a front photoreceptor surface 50A and a back photoreceptor surface 50B. Also, it is seen that the surfaces of the first control grid 12 and the second control grid 22 are, first, parallel with each other and, second, parallel with the front photoreceptor surface 50A. As shown in FIG. 1, a first spring-loaded backer bar 53 and a second spring-loaded backer bar 54 are arranged to urge against the back photoreceptor surface 50B to thereby maintain a constant distance 60 between the surfaces of the first control grid 12 and the second control grid 22 and the front photoreceptor surface 50A of about 1.5–2.0 mm.

Figure 1B:
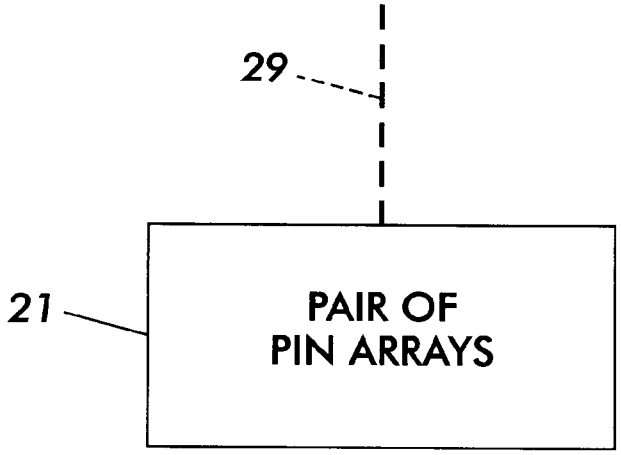
FIG. 1B depicts the FIG. 1 first charge-generating emitter 11.

The first charge-generating emitter 11 comprises a first pair of pin arrays, each pin thereof emitting a first pin current that is generally high. The first pair of pin arrays is depicted in FIG. 1A. In one embodiment, each pin array of the first pair of pin arrays comprises the pin array 10 of the aforementioned U.S. Pat. No. 4,725,732 to Joseph H. Lang et al. As well, the second charge-generating emitter 21 comprises a second pair of pin arrays, each pin thereof emitting a second pin current that is generally low. The second pair of pin arrays is depicted in FIG. 1B. In one embodiment, each pin array of the second pair of pin arrays comprises the pin array 10 of the aforementioned U.S. Pat. No. 4,725,732 to Joseph H. Lang et al.

In one embodiment, the first pin current exceeds 7.5 micro-Ampere per pin, and the second pin current is equal to or less than 7.5 micro-Ampere per pin.

In one embodiment, each charging device of the first DC pin scorotron charging device 10 and the second DC pin scorotron charging device 20 comprises a DC pin scorotron that is similar to that described in the aforementioned U.S. patent to Joseph H. Lang et al.

Figure 2:
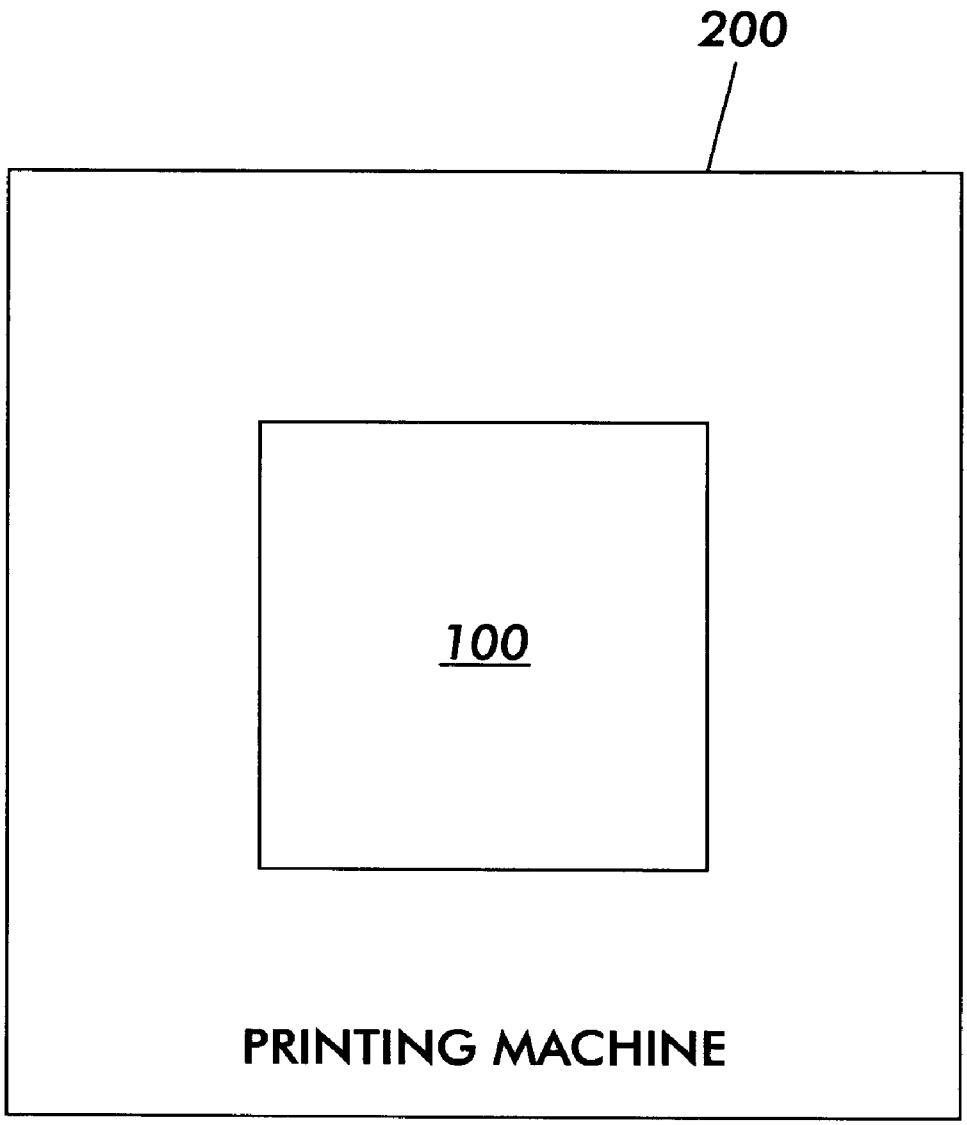
FIG. 2 depicts the FIG. 1 second charge-generating emitter 21.
Figure 3:
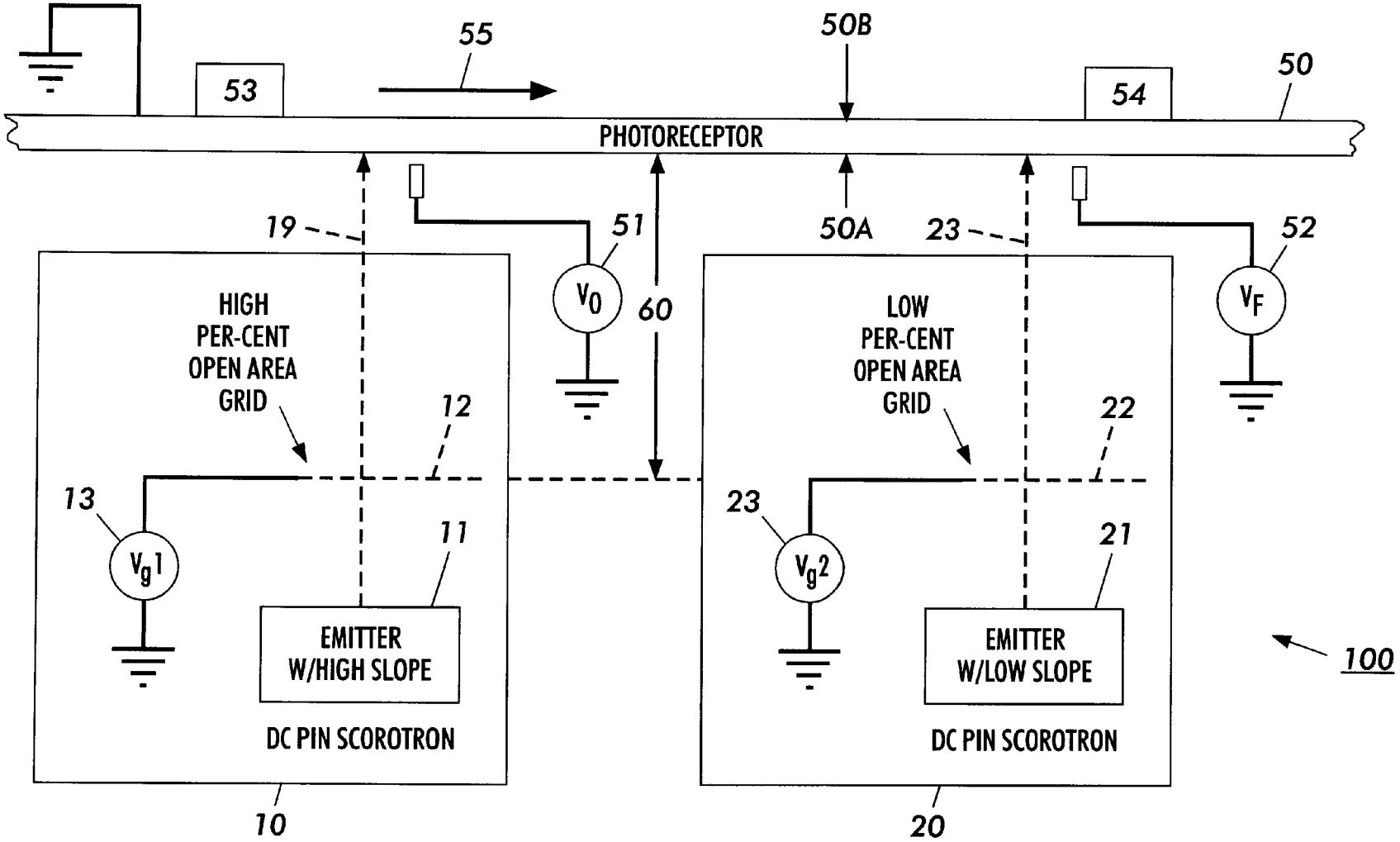
FIG. 3 is a block diagram depicting a printing machine 200, which printing machine comprises the DC pin scorotron charging apparatus 100.

Referring now to FIG. 2, there is depicted a printing machine 200 comprising an apparatus 100 for charging a photoreceptor, in accordance with the present invention. It will be understood that the apparatus 100 of FIG. 2 is identical to the DC pin scorotron charging apparatus 100 depicted in FIG. 1 and described in the foregoing written description corresponding thereto.

In summary, the DC pin scorotron charging apparatus 100, in accordance with the present invention, provides a low-cost negative charging solution. In contrast, previous pin scorotrons could maintain a charging uniformity of about plus or minus 25 volts for mid-range process speeds. However, current and future copying and printing machine programs have very high image-quality requirements. The charging uniformity becomes an important issue in achieving these requirements. Based on the system model, the charging uniformity should be controlled within plus or minus 7 volts (two sigma) in order to achieve the image quality goals. This is a very challenging task since no previous products have achieved this goal based on DC pin scorotrons. While some possible alternate technologies include discorotrons and AC wire scorotrons, unfortunately, however, these latter alternate technologies are much more expensive than the DC pin scorotrons.

The problem, therefore, is to design a DC pin scorotron charging system with high slope while minimizing overshoot and uniformity problems.

Returning again to FIG. 1, it will be understood that the present invention combines two separate DC pin scorotron devices 10 and 20 with different functions and performance goals.

In the following illustrative example, it is assumed that it is desired to achieve a final target voltage 52 of 650 volts.

The first DC pin scorotron device 10 acts as a high-slope device and has a high intermediate overshoot voltage 51. This first DC pin scorotron device 10 is used to charge-up the photoreceptor 50 close to the target final voltage 52 of 650 volts. The DC pin scorotron charging apparatus 100, in accordance with the present invention, handles the high overshoot voltage 51 by setting the first grid potential 13 lower than the target final potential 52. The first control grid 12's percent open area is 70–80%; the first grid voltage 13 is 500 volts; the first emitter pin current exceeds 7.5 micro-Amperes per pin; the first emitter slope is about 1.8–3.5 micro-Ampere per volt-meter; and the resulting average overshoot voltage is about 100–120 volts. Thus, the photoreceptor intermediate overshoot potential 51 after the first DC pin scorotron charging device 10 is about 600–620 volts. The typical charging uniformity is about plus or minus 25 volts. However, this charging uniformity is unacceptable since many other factors such as coronode surface condition and differences in photoreceptor initial voltage across the surface at the entrance to the device will affect the performance. The first DC pin scorotron charging device 10 delivers the majority of charging current and brings the photoreceptor 50's potential close to the desired target final voltage 52 of 650 volts.

The second DC pin scorotron charging device 20 has a low slope with a low overshoot. This second DC pin scorotron charging device 20 is used to charge the photoreceptor 50 up slightly while leveling any charging non-uniformity. The second control grid 22's open area is 50%; the second emitter pin current is 5.5–7.5 micro-Amperes per pin; the second emitter slope is about 1.0–2.0 micro-Ampere per volt-meter.

In one embodiment, each emitter of the first emitter 11 and the second emitter 21 comprises dual pin arrays spaced at 13 mm in the process direction, each array comprising 118 pins spaced at 3 mm intervals. Also in this embodiment, each control grid of the first control grid 12 and the second control grid 22 is 34 mm wide in the process direction and spaced 7.5 mm from the ends of its corresponding pins. Further, the first emitter 11 and second emitter 21 are parallel so that one pin array of emitter 11 directly faces one pin array of emitter 21 at a spacing therebetween of 30–60 mm.

As a result, the DC pin scorotron charging apparatus 100, in accordance with the present invention, is low cost, high speed, and provides good charging uniformity.

While various embodiments of a DC pin scorotron charging apparatus, and a printing machine arranged with the same, in accordance with the present invention, have been described hereinabove, the scope of the invention is defined by the following claims.

What is claimed is:

1. DC pin scorotron charging apparatus for charging a photoreceptor to a final voltage, the DC pin scorotron charging apparatus comprising a first DC pin scorotron charging device for initially charging the photoreceptor to an intermediate overshoot voltage and a second DC pin scorotron charging device for thereafter uniformly charging the photoreceptor to the final voltage, the first DC pin scorotron charging device comprising a first control grid with a first grid percent open area that is generally high, the second DC pin scorotron charging device comprising a second control grid with a second grid percent open area that is generally low.

2. The DC pin scorotron charging apparatus of claim 1, the first grid percent open area being at or above 70 percent.

3. The DC pin scorotron charging apparatus of claim 1, the second grid percent open area being less than 70 percent.

4. The DC pin scorotron charging apparatus of claim 1, wherein the first DC pin scorotron charging device acts as a high-slope device and has a high intermediate overshoot voltage and is used to charge-up the photoreceptor to the intermediate overshoot voltage that is close to the target final voltage.

5. The DC pin scorotron charging apparatus of claim 1, wherein the second DC pin charging device has a low slope with a low overshoot and is used to charge the photoreceptor up slightly to the final voltage while leveling any charging non-uniformity.

6. DC pin scorotron charging apparatus for charging a photoreceptor to a final voltage, the DC pin scorotron charging apparatus comprising a first DC pin scorotron charging device for initially charging the photoreceptor to an intermediate overshoot voltage and a second DC pin scorotron charging device for thereafter uniformly charging the photoreceptor to the final voltage, the first DC pin scorotron charging device comprising a first control grid with a first grid percent open area that is generally high, the second DC pin scorotron charging device comprising a second control grid with a second grid percent open area that is generally low, the first DC pin scorotron charging device comprising a first charge-generating emitter with a first emitter dl/dV ("slope") that is generally high, the second DC pin scorotron charging device comprising a second charge-generating emitter with a second emitter slope that is generally low.

7. The DC pin scorotron charging apparatus of claim 6, the first emitter slope exceeding 2.0 micro-Ampere per volt-meter.

8. The DC pin scorotron charging apparatus of claim 6, the second emitter slope being less than 2.0 micro-Ampere per volt-meter.

9. The DC pin scorotron charging apparatus of claim 6, the distance between the first and second control grids' surfaces and the photoreceptor surface being maintained at a constant value of about 1.5–2.0 mm.

10. The DC pin scorotron charging apparatus of claim 6, the first charge-generating emitter comprising a first pair of pin arrays, each pin thereof emitting a first pin current that is generally high, the second charge-generating emitter comprising a second pair of pin arrays, each pin thereof emitting a second pin current that is generally low.

11. The DC pin scorotron charging apparatus of claim 10, the first pin current being greater than 7.5 micro-Ampere per pin.

12. The DC pin scorotron charging apparatus of claim 10, the second pin current being equal to or less than 7.5 micro-Ampere per pin.

13. The DC pin scorotron charging apparatus of claim 6, wherein the first DC pin scorotron charging device acts as a high-slope device and has a high intermediate overshoot voltage and is used to charge-up the photoreceptor to the intermediate overshoot voltage that is close to the target final voltage.

14. The DC pin scorotron charging apparatus of claim 6, wherein the second DC pin charging device has a low slope with a low overshoot and is used to charge the photoreceptor up slightly to the final voltage while leveling any charging non-uniformity.

15. A printing machine comprising DC pin scorotron charging apparatus for charging a photoreceptor to a final voltage, the DC pin scorotron charging apparatus comprising a first DC pin scorotron charging device for initially charging the photoreceptor to an intermediate overshoot voltage and a second DC pin scorotron charging device for thereafter uniformly charging the photoreceptor to the final voltage, the first DC pin scorotron charging device comprising a first control grid with a first grid percent open area that is generally high, the second DC pin scorotron charging device comprising a second control grid with a second grid percent open area that is generally low.

16. The printing machine of claim 15, the first grid percent open area being at or above 70 percent.

17. The printing machine of claim 15, the second grid percent open area being less than 70 percent.

18. The printing machine of claim 15, wherein the first DC pin scorotron charging device acts as a high-slope device and has a high intermediate overshoot voltage and is used to charge-up the photoreceptor to the intermediate overshoot voltage that is close to the target final voltage.

19. The printing machine of claim 15, wherein the second DC pin charging device has a low slope with a low overshoot and is used to charge the photoreceptor up slightly to the final voltage while leveling any charging non-uniformity.

20. A printing machine comprising DC pin scorotron charging apparatus for charging a photoreceptor to a final voltage, the DC pin scorotron charging apparatus comprising a first DC pin scorotron charging device for initially charging the photoreceptor to an intermediate overshoot voltage and a second DC pin scorotron charging device for thereafter uniformly charging the photoreceptor to the final voltage, the first DC pin scorotron charging device comprising a first control grid with a first grid percent open area that is generally high, the second DC pin scorotron charging device comprising a second control grid with a second grid percent open area that is generally low, the first DC pin scorotron charging device comprising a first charge-generating emitter with a first emitter dl/dV ("slope") that is generally high, the second DC pin scorotron charging device comprising a second charge-generating emitter with a second emitter slope that is generally low.

21. The printing machine of claim 20, the first emitter slope exceeding 2.0 micro-Ampere per volt-meter.

22. The printing machine of claim 20, the second emitter slope being less than 2.0 micro-Ampere per volt-meter.

23. The printing machine of claim 20, the distance between the first and second control grids' surfaces and the photoreceptor surface being maintained at a constant value of about 1.5–2.0 mm.

24. The printing machine of claim 20, the first charge-generating emitter comprising a first pair of pin arrays, each pin thereof emitting a first pin current that is generally high, the second charge-generating emitter comprising a second pair of pin arrays, each pin thereof emitting a second pin current that is generally low.

25. The printing machine of claim 24, the first pin current being greater than 7.5 micro-Ampere per pin.

26. The printing machine of claim 24, the second pin current being equal to or less than 7.5 micro-Ampere per pin.

27. The printing machine of claim 20, wherein the first DC pin scorotron charging device acts as a high-slope device and has a high intermediate overshoot voltage and is used to charge-up the photoreceptor to the intermediate overshoot voltage that is close to the target final voltage.

28. The printing machine of claim 20, wherein the second DC pin charging device has a low slope with a low overshoot and is used to charge the photoreceptor up slightly to the final voltage while leveling any charging non-uniformity.

* * * * *